US012102204B2

(12) United States Patent
Lelieveld

(10) Patent No.: US 12,102,204 B2
(45) Date of Patent: Oct. 1, 2024

(54) BATTERY-OPERATED HAIR DRYER

(71) Applicant: KONINKLIJKE PHILIPS N.V., Eindhoven (NL)

(72) Inventor: Mark Johannes Lelieveld, Shatin (HK)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 707 days.

(21) Appl. No.: 17/277,326

(22) PCT Filed: Sep. 29, 2019

(86) PCT No.: PCT/EP2019/076336
§ 371 (c)(1),
(2) Date: Mar. 18, 2021

(87) PCT Pub. No.: WO2020/070032
PCT Pub. Date: Apr. 9, 2020

(65) Prior Publication Data

US 2022/0022622 A1 Jan. 27, 2022

(30) Foreign Application Priority Data

| | | |
|---|---|---|
| Oct. 3, 2018 | (EP) | 18198507 |
| Nov. 23, 2018 | (EP) | 18207951 |
| Jan. 25, 2019 | (EP) | 19153685 |

(51) Int. Cl.
*A45D 20/12* (2006.01)

(52) U.S. Cl.
CPC ..... *A45D 20/12* (2013.01)

(58) Field of Classification Search
CPC ..... A45D 20/12
(Continued)

(56) References Cited

U.S. PATENT DOCUMENTS 4,555,232 A * 11/1985 Raccah ..... A45D 20/06 431/255
4,800,654 A * 1/1989 Levin ..... A45D 1/02 431/153
(Continued)

FOREIGN PATENT DOCUMENTS

CN 113015460 B * 8/2022 ..... A45D 20/12
EP 2160954 3/2010
(Continued)

OTHER PUBLICATIONS

International Search Report and Written Opinion Dated Oct. 30, 2019 For International Application No. PCT/EP2019/076336 Filed Sep. 29, 2019.
(Continued)

*Primary Examiner* — Stephen M Gravini

(57) ABSTRACT

A battery-operated hair dryer comprises a battery (B), and a fan (F) having rotating fan blades propelled by a motor (M) that is powered by the battery (B), and non-rotating static air flow-shaping vanes (V) between the motor (M) and a motor mount (MM), which non-rotating static airflow-shaping vanes (V) serve as cooling ribs for the battery (B) that is mounted adjacent to the fan (F). Preferably, the battery (B) is positioned adjacent to a motor mount (MM) of the motor (M) of the fan (F). Advantageously, the battery (B) is at least partly positioned in a handle of the battery-operated hair dryer, the fan (F) being positioned adjacent to the handle.

2 Claims, 1 Drawing Sheet

(58) Field of Classification Search
USPC ..... 34/95–100
See application file for complete search history.

(56) References Cited

U.S. PATENT DOCUMENTS

| | | | | |
|---|---|---|---|---|
| 6,718,651 | B2 * | 4/2004 | Perez | A45D 20/30 392/374 |
| 7,913,416 | B1 * | 3/2011 | Scieri | A45D 20/10 34/96 |
| 8,434,238 | B2 * | 5/2013 | Gross | A45D 20/12 132/212 |
| 9,526,311 | B1 * | 12/2016 | Schaefer | A45D 20/10 |
| 10,299,560 | B1 * | 5/2019 | Nelson | H01M 50/569 |
| 11,388,973 | B2 * | 7/2022 | Lei | A45D 20/12 |
| 11,464,313 | B2 * | 10/2022 | Wang | A45D 20/12 |
| 2004/0216322 | A1 * | 11/2004 | Collier | A45D 20/06 34/97 |
| 2018/0233788 | A1 | 8/2018 | Goldman | |
| 2022/0022622 | A1 * | 1/2022 | Lelieveld | A45D 20/12 |

FOREIGN PATENT DOCUMENTS

| | | | | |
|---|---|---|---|---|
| EP | 2255692 | | 12/2010 | |
| EP | 3632258 | A1 * | 4/2020 | |
| EP | 3860394 | B1 * | 2/2022 | A45D 20/12 |
| JP | H03244407 | A | 10/1991 | |
| JP | 2007044082 | A | 2/2007 | |
| JP | 2021528209 | A * | 10/2021 | |
| RU | 2278606 | C2 * | 6/2006 | A45D 20/12 |
| WO | WO-0221967 | A1 * | 3/2002 | A45D 20/12 |
| WO | WO-2020070032 | A1 * | 4/2020 | A45D 20/12 |

OTHER PUBLICATIONS

Written Opinion of the International Preliminary Examining Authority Dated Mar. 30, 2020 For International Application No. PCT/EP2019/076336 Filed Sep. 29, 2019.

International Preliminary Report On Patentability Dated Feb. 4, 2021 For International Application No. PCT/EP2019/076336 Filed Sep. 29, 2019.

* cited by examiner

BATTERY-OPERATED HAIR DRYER

CROSS REFERENCE TO RELATED APPLICATIONS

This application is the U.S. National Phase application under 35 U.S.C. § 371 of International Application No. PCT/EP2019/076336 filed Sep. 29, 2019, which claims the benefit of European Patent Application Number 18198507.8 filed Oct. 3, 2018, European Patent Application Number 18207951.7 filed Nov. 23, 2018, and European Patent Application Number 19153685.3 filed Jan. 25, 2019. These applications are hereby incorporated by reference herein.

FIELD OF THE INVENTION

The invention relates to a battery-operated hair dryer. In this disclosure, the notion hair dryer is not limited to devices that just dry hair, like a blow dryer. A hair dryer can also be used to style hair, and may take the form of a brush or curler blowing warm air, and may alternatively be called an air styler.

BACKGROUND OF THE INVENTION

US 2018/0233788 discloses a battery-powered blow dryer configured to simultaneously cool the batteries and improve hair dryer performance. All batteries have a level of internal electrical resistance/impedance, which generates heat during both charging and discharging. Thus, using batteries to power a heating element and fan also generates heat within the batteries, battery packs, or internal circuitry as they discharge. This heat can shorten the life of the batteries, and may affect the discharge rate or run time of the batteries. Thus, a battery-operated blow dryer is disclosed that is capable of cooling to batteries and related circuitry to increase their performance, avoid overheating and safety issues, and/or extend the life of the batteries. The handle may include a handle air flow channel in communication with a case air flow channel, so that air flowing through the handle exits into the case air flow channel. The batteries may be positioned within the channel with gaps being formed between the handle and batteries that allow air flow around the batteries. To cool the batteries, the handle may include one or more intake vents that allows in air to flow up the channel in the handle over the batteries and gaps between the individual cells. The fan draws air that flows around the battery cells, then continues through the case and is blown over the heating element. While the air flow is cooling the batteries, the air flow is also being warmed, and the battery-warmed air flows to the heating element and is not wasted.

EP 2255692 discloses a device for drying hair, comprising a hand-held unit to emit or discharge a flow of air to be directed onto the hair. The hand-held unit has a power source which is arranged in a path of the air flow emitted or discharged from the unit. In this way, heat energy which is generated in the power source can be transferred directly to the air flow in the device.

U.S. Pat. No. 9,526,311 discloses a battery powered hairdryer that is powered by a rechargeable lithium ion battery. The heat from the battery is directly used to heat the forced air created by the hairdryer fan. This is accomplished by situating the battery in the path of the forced air, or by connecting the battery to a heat sink and disposing at least part of the heat sink in the path of the forced air. To further improve efficiency, the fan motor is situated in the path of the forced air. All circuitry within the hairdryer is either disposed in the path of the forced air, or thermally connected to the heat sink which is at least partially disposed in the path of the forced air. In this way, any heat created by the hairdryer's electrical components is used to preheat the forced air within the hairdryer. The preheated air is then further heated by the heating element within the hairdryer.

SUMMARY OF THE INVENTION

It is, inter alia, an object of the invention to provide an improved hair dryer. The invention is defined by the independent claims. An advantageous embodiment is defined in the dependent claims.

One aspect of the invention provides a battery-operated hair dryer comprising a dryer house, a battery, and a fan having rotating fan blades propelled by a motor that is powered by the battery, and around the motor, non-rotating static air flow-shaping vanes between the motor and a motor mount, which non-rotating static airflow-shaping vanes serve as cooling ribs for the battery that is mounted adjacent to the fan, the motor mount being between the non-rotating static airflow shaping vanes and the dryer housing, wherein, the battery is mounted around or against the motor mount. Advantageously, the battery is partly positioned in a handle of the battery-operated hair dryer, the fan being positioned adjacent to the handle.

Embodiments are based on the following considerations. In hair dryers, weight and weight distribution are very important. Embodiments of the invention use the non-rotating static airflow-shaping vanes at the outlet side of the hair dryer fan inside the hair dryer, as a heat sink for the batteries of a hair dryer. This results in minimizing components (as a single component will act both as a non-rotating static airflow-shaping vane and as heat sink), and putting the battery close to the fan also results in a good weight distribution (as the fan is nicely in the middle of the hair dryer). Moreover, the non-rotating static airflow-shaping vanes at the outlet of the fan are also handling all air from the fan, so that cooling efficiency will be optimal. Using the non-rotating static airflow-shaping vanes as battery cooling bodies, and thus mounting the battery close to the fan, results in that the weight distribution is optimal, and in that there is less need for cooling channels to cool the batteries, which cooling channels may cause noise.

These and other aspects of the invention will be apparent from and elucidated with reference to the embodiments described hereinafter.

DESCRIPTION OF EMBODIMENTS

Figure 1:
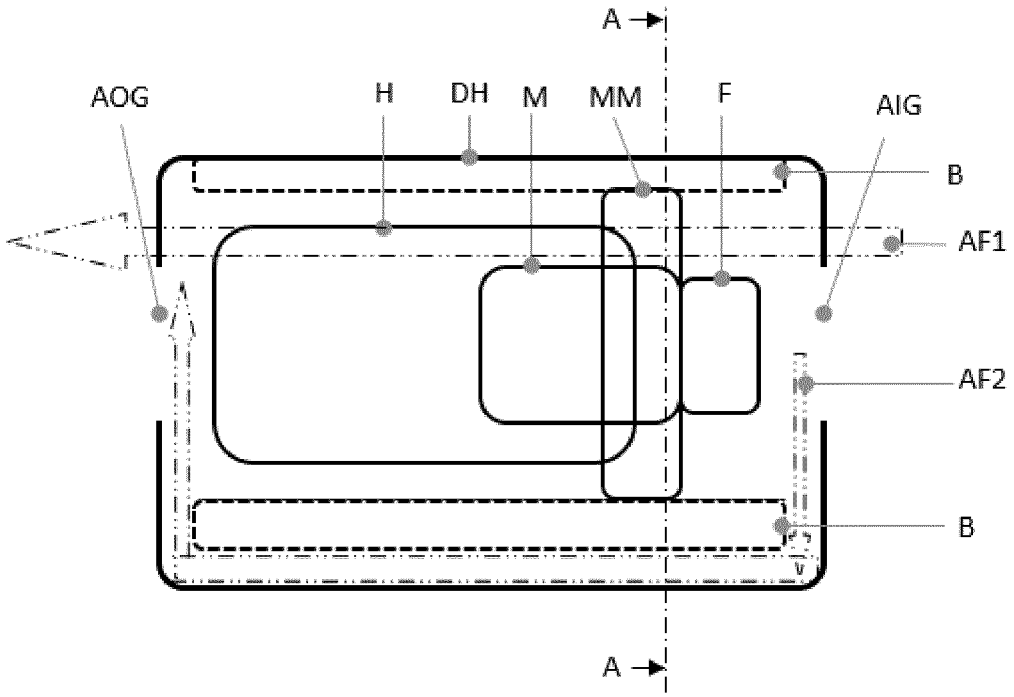
FIG. 1 illustrates an embodiment of a battery-operated hair dryer according to the invention.
Figure 2:
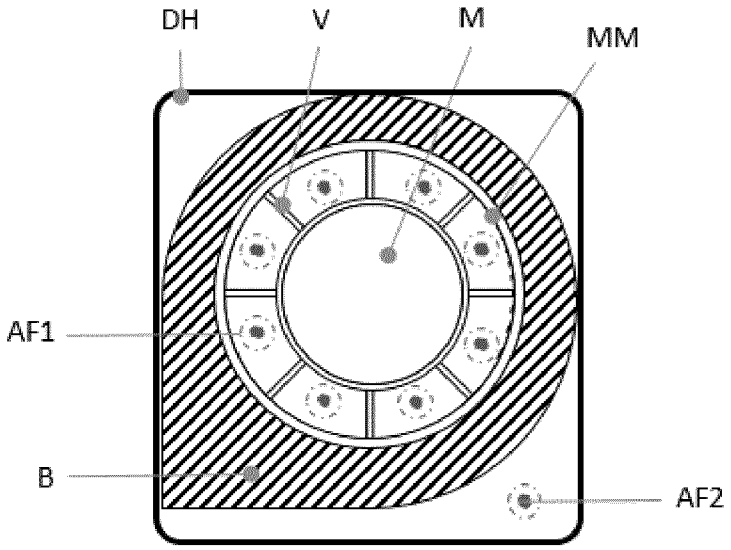
FIG. 2 shows a cross-section through line A-A in FIG. 1.

FIGS. 1 and 2 schematically illustrate a battery-operated hair dryer having a dryer housing DH. A main air flow AF1 flows rather straightforward from an air inlet grill AIG to an air outlet grill AOG. The air flow is caused by a fan F propelled by a motor M that is fitted in a motor mount MM. To be able to dry and/or style hair, air from the fan F is heated by a heater H. The heater H and the motor M are powered by a battery B around the fan F, motor M and motor mount MM.

As shown in FIG. 2, the fan F has non-rotating static air-flow-shaping vanes V between the motor M and the motor mount MM. As a result of the battery B being positioned (immediately) adjacent to (i.e. mounted around or against) the motor mount MM, and thus in close contact with the fan's non-rotating static airflow-shaping vanes V, the fan's non-rotating static airflow-shaping vanes V act as cooling ribs to cool the battery B by means of the main air flow AF1.

As the speed of the main air flow AF1 is relatively high when the air is passing the relatively narrow openings in the motor mount MM, the possibilities for the battery B to be cooled at that point is optimal.

In the embodiment shown, the battery B has more volume at the bottom of the dryer housing DH than at the top of the dryer housing DH. If so, there may be an additional need for cooling the battery B at the bottom. To that end, it is possible to have a secondary air flow AF2 from the air inlet grill AIG to the air outlet grill AOG along the bottom of the dryer housing DH.

It should be noted that the above-mentioned embodiments illustrate rather than limit the invention, and that those skilled in the art will be able to design many alternative embodiments without departing from the scope of the appended claims. There is no need for the dryer housing DH to have a rectangular cross-section; it may e.g. be round. The heater H may be in series with the motor M or parallel to the motor M. The battery B may be shaped in such a way, that its weight distribution is optimal for a hand-held hair dryer. The asymmetrical shape of the battery B shown in FIG. 2 is less favorable in the shown orientation of the dryer housing DH, but if the dryer housing DH is rotated in such a way that its left lower corner becomes the bottom (i.e. the handle of the hair dryer would be mounted to what is shown to be the left lower corner of the dryer housing DH), such a battery shape may be very favorable to get a good weight distribution. To get a good weight distribution, the battery B may be partly placed in the handle, while the fan F is positioned sufficiently adjacent to the battery B so that the fan's non-rotating static airflow-shaping vanes V can still serve to cool the battery B. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements. In the device claim enumerating several means, several of these means may be embodied by one and the same item of hardware.

The invention claimed is:

1. A battery-operated hair dryer comprising:

a hair dryer housing;

a battery; and a fan having rotating fan blades propelled by a motor that is powered by the battery, wherein: around the motor, the fan has non-rotating static airflow-shaping vanes between the motor and a motor mount, the non-rotating static airflow-shaping vanes mounted around or against the motor mount, and serving as cooling ribs for the battery that is mounted adjacent to the fan, the motor mount being between the non-rotating static airflow-shaping vanes and the dryer housing; and the battery is mounted around or against the motor mount.

2. A battery-operated hair dryer as claimed in claim 1, wherein the battery is partly positioned in a handle of the battery-operated hair dryer, the fan being positioned adjacent to the handle.

* * * * *